United States Patent [19]

Griffith

[11] Patent Number: 4,787,273

[45] Date of Patent: Nov. 29, 1988

[54] WRENCH RETAINING DEVICE

[76] Inventor: Donald J. Griffith, 6025 Twin Rock Ct., Colorado Springs, Colo. 80907

[21] Appl. No.: 426,673

[22] Filed: Sep. 29, 1982

[51] Int. Cl.[4] ..... B25B 13/00

[52] U.S. Cl. ..... 81/13; 81/125

[58] Field of Search ..... 81/13, 119, 125, 180 C, 81/180 D, 456–458, 185.2, 180.1, 13, 119, 125, 456–458

[56] References Cited

U.S. PATENT DOCUMENTS

| | | | |
|---|---|---|---|
| 911,924 | 2/1909 | Vader | 81/180 D |
| 1,550,436 | 8/1925 | Hall | 81/119 |
| 1,558,276 | 10/1925 | McGuckin . | |
| 1,635,102 | 7/1927 | Watson . | |
| 1,706,427 | 3/1929 | Wachsmuth | 87/180 C |
| 2,557,628 | 6/1951 | Becker | 81/125 |
| 2,659,258 | 11/1953 | Dillard | 81/125 |
| 2,697,371 | 12/1954 | Bowman | 81/119 |
| 4,016,783 | 4/1977 | Spector et al. | 81/125 X |

*Primary Examiner*—Debra Meislin
*Attorney, Agent, or Firm*—Timothy J. Martin

[57] ABSTRACT

A wrench retaining clip mounts on the shank of a wrench and is operative to retain a working head of the wrench in an engaged position on a nut or bolt head of a threaded bolt. The clip includes a channel-shaped yoke which extends partially around the wrench shank. A prong member extends longitudinally from the yoke and has a free end adapted to engage the threads of the bolt, and the yoke is slideable on the wrench shank to move the prong into and out of this engaged position. A releaseable locking mechanism is formed by a pair of resilient arcuate arms extending from the yoke in a semi-circle. These arms may releaseably embrace the working head of the wrench to lock the yoke and prong into the engaged position with the prong being biased into thread engagement. A notch is preferably formed at the free end of the prong to mate with adjacent side surfaces of the nut or bolt head where thread engagement is difficult or impossible. In one alternative embodiment, a second set of resilient, arcuate arms and a second prong are positioned on the end of the yoke opposite the first set, and a second alternate embodiment includes enlarged nubs at the free ends of the arcuate arms. In another alternative, the prong includes a shoulder which can engage the inner side wall of the wrench working head.

17 Claims, 2 Drawing Sheets

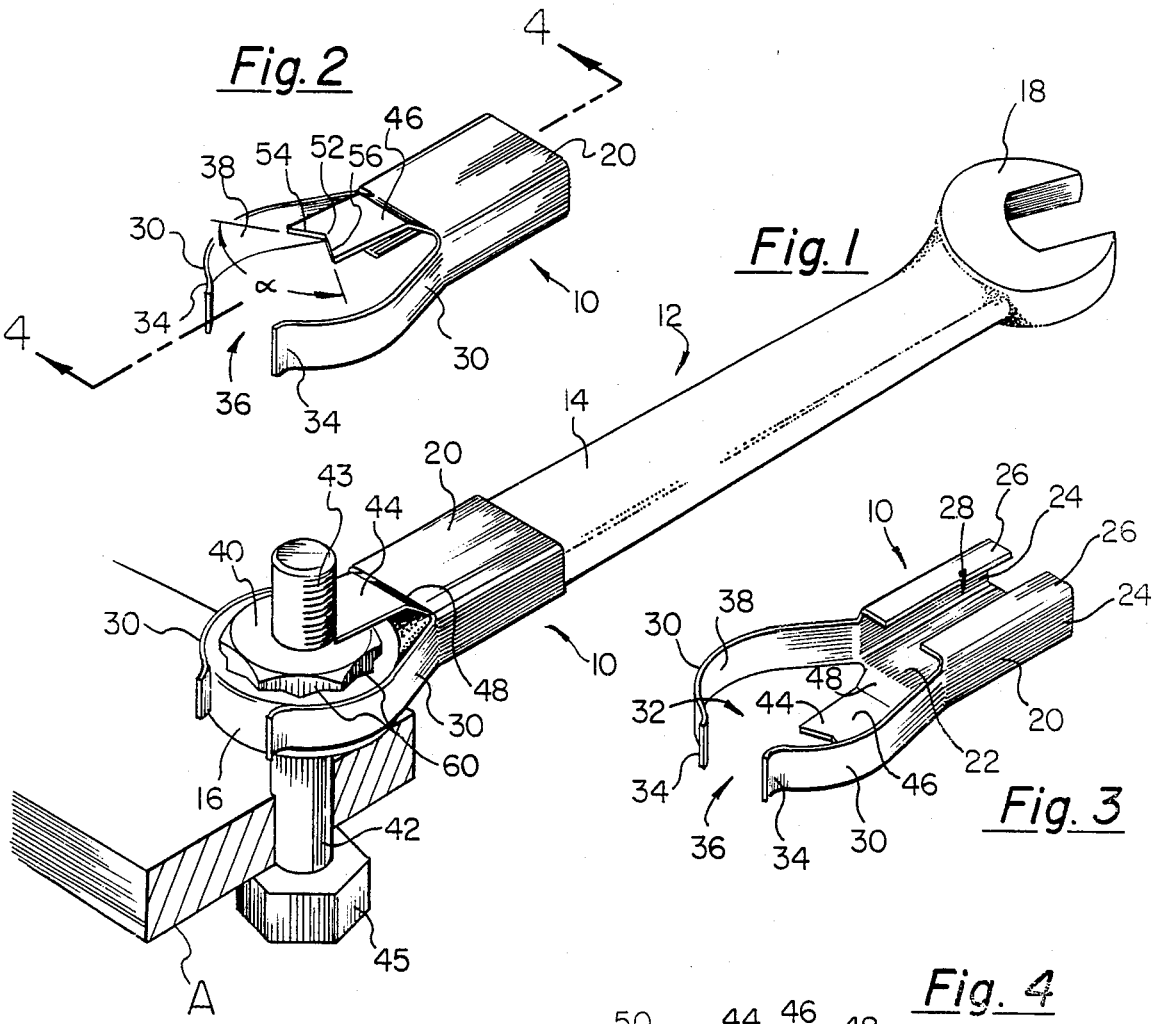
Fig. 2
4
46
38
54
52
56
20
30
34
α
10
4
36
34
30
Fig. 1
18
12
14
20
43
44
40
30
48
30
60
16
42
45
A
10
26
28
24
26
24
38
30
32
44
48
20
22
34
46
36
34
30
Fig. 3
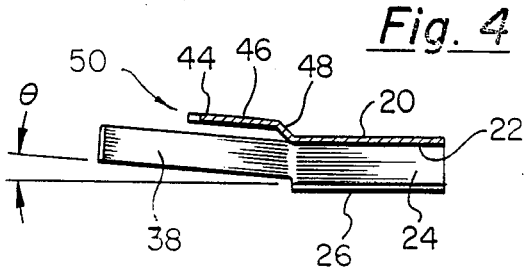
Fig. 4
50
44
46
48
θ
20
22
38
26
24
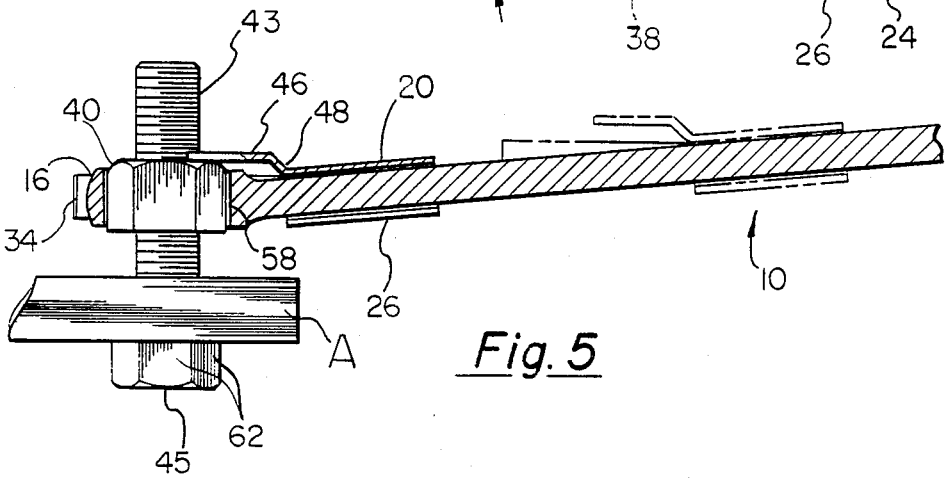
43
46
20
40
48
16
34
58
26
10
A
45
62
Fig. 5

Fig. 6
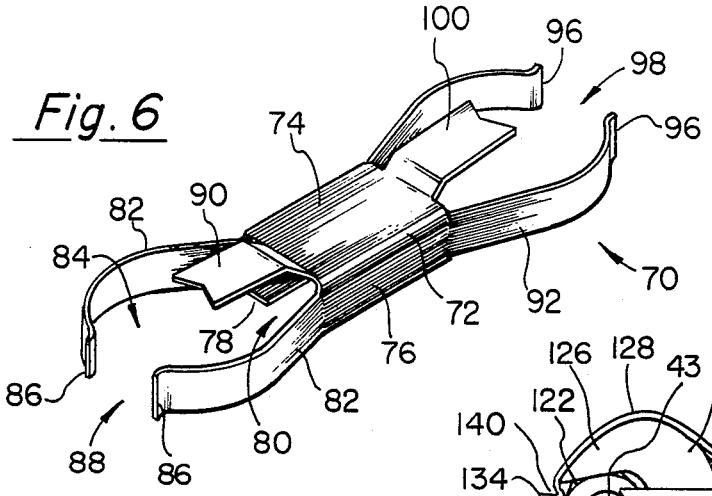
Fig. 7
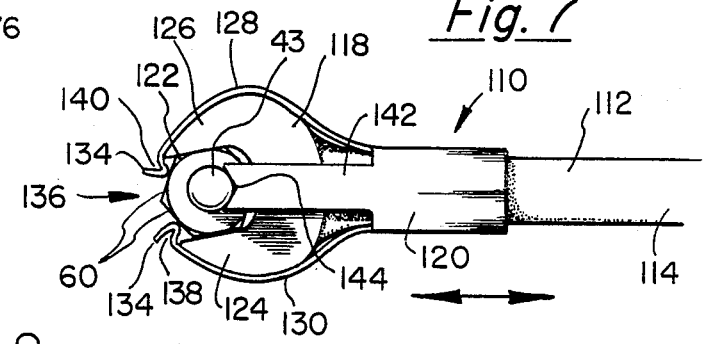
Fig. 8
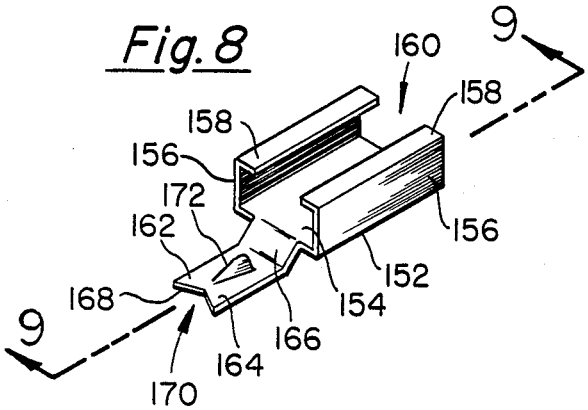
Fig. 9
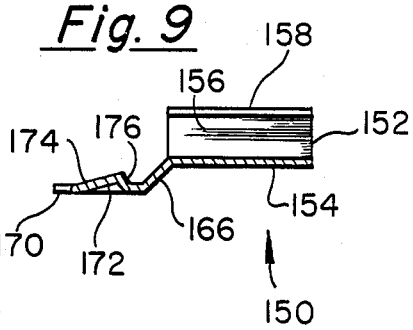
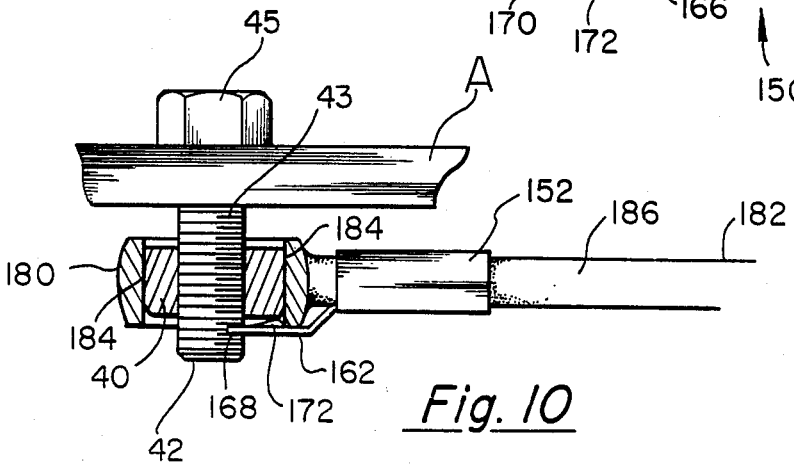
Fig. 10

WRENCH RETAINING DEVICE

BACKGROUND OF THE INVENTION

The present device is directed to an apparatus for retaining the working head of a wrench in a mounted position upon the nut or bolt head of a threaded bolt and nut combination. In its preferred form, the invention helps retain the working head of a wrench on either the nut or upon the bolt head so that the working head resists movement in a longitudinal direction along the bolt axis. The device according to this invention is constructed to be either a retrofit attachment for a wrench, but the apparatus could be manufactured with the wrench as a unit.

Many mechanics have experienced the problem of wrench head dislocation when using a wrench on a nut or bolt head. This is often experienced when a mechanic finds it necessary to place a pair of wrenches on a nut and bolt combination, one wrench being placed upon the bolt head and the other wrench being placed upon the nut. Should the nut and bolt head be located in areas of difficult access or should the head of the bolt and the nut be spaced a substantial distance apart, the mechanic often experiences the problem where the working head of one of the wrenches slips off of its respective work piece. In such situations, the mechanic often requires the assistance of a helper to hold one of the wrenches on its repective work piece while the mechanic operates the other wrench to either tighten or loosen the bolt and nut. This can be frustrating to the mechanic and lacks efficiency since two workers are required to perform a rather simple operation.

While some wrenches have been developed in the past which had as their objective the positioning of the working head of a wrench on a bolt, these devices were directed to preventing movement of the working head along the bolt axis in one direction. None of the prior art known to the inventor of the present invention developed structure which prevented movement of the working head in all directions along the axis of the bolt in order to releaseably lock the wrench head on the nut or bolt without requiring substantial and expensive modification of an existing wrench.

For example, U.S. Pat. No. 2,659,258 issued Nov. 17, 1953 to Dillard shows a bolt holding box wrench which is capable of retaining the working head of a wrench on a nut or a bolt head. This wrench requires substantial modification to an existing wrench structure or which requires special manufacture. In this patent, one or more elongated set screws are mounted in brackets on the shaft of a wrench and extend radially through the working head. By turning the set screws, the free end of the screw may be advanced to tighten onto a bolt head or nut located within the working head of the wrench.

U.S. Pat. No. 2,697,371 issued Dec. 21, 1954 to Bowman shows a wrench which is provided with a slideable plate so as to selectively mask a portion of the opening of the working head of a wrench so that the bolt head or nut will abutt this sliding plate to prevent movement in one direction along the axis of the bolt when the working head is positioned on a nut or bolt head. Accordingly, this patent shows a device that provides a moveable side wall for the opening in the working head. U.S. Pat. No. 1,550,436 issued Aug. 18, 1925 to Hall shows a somewhat similar structure to that of the Bowman patent in that it provides an auxillary wall which prevents movement of the wrench working head in one direction along a bolt once it has engaged a nut.

Despite these prior art patents and until the present invention, there remained a need for a simple device which could releasably retain a wrench, such as a box end wrench, on a work piece in the form of a nut or a bolt head. There was a further need for such a device to be simple in construction yet which could readily retrofit a wrench without the need for altering the wrench or undermining the integrity of the wrnech's working head.

SUMMARY OF THE INVENTION

It is an object of the present invention to provide a novel and useful retaining device which can releaseably retain the working head of the wrench on a nut or bolt head so that the working head of the wrench will not move in any longitudinal direction along the bolt axis.

Another object of the present invention is to provide an inexpensive retaining clip which can be used on existing wrenches to releaseably lock a working head thereof on a nut or bolt head, which clip requires no modification of those wrenches.

A further object of the present invention is to provide a retaining device for wrenches which can releaseably secure the working head of a box end wrench in a releaseably locked orientation on a nut which device can easily be mounted upon and removed from the shank of an existing wrench.

These objects are accomplished by the preferred form of the present invention directed to an apparatus which may be mounted on an existing wrench, such as a box end wrench. This apparatus is in the form of a retaining clip which can be used by a mechanic to mount the working head of a wrench on a nut and bolt combination in such a manner that the wrench will be locked onto the nut and bolt combination without the need for the mechanic to manually hold the wrench thereon.

To this end, the clip device, according to the present invention, broadly comprises a main body preferably in the form of a channel-shaped yoke which is adapted to spring-fit around the elongated shank of a standard wrench. The yoke is slideable along the longitudinal axis of the shank, and a prong extends from the yoke so that, when the wrench head is mounted on a nut or bolt head, the prong may be moved between a position engaging the threads of the threaded bolt and a disengaged position. A means for releaseably locking the prong in the engaged position and for biasing the prong into this engaged position is also provided.

In the preferred form of the present invention, this locking means comprises a pair of resilient, arcuate arms extending in a common direction from the end of the yoke to form a semi-circle generally surrounding the prong. As the yoke and prong are advanced into a position wherein the prong engages the threaded bolt, these resilient arms spring-fit around the working head of the wrench so that they releaseably embrace the working head thereby biasing the prong into the engaged position and retaining the prong in such position.

Additional features are provided to further facilitate the gripping of the working head by the resilient arms. In the preferred embodiment, each arm terminates in a reverse curved end as an aid in moving the arms apart from one another as they are moved into a surrounding relation about the working head. Also, in the preferred form of the present invention, the plane defined by the resilient arms is canted or angled at a small acute angle of approximately 5° to 15° with respect to the longitudinal axis of the yoke. Further, to facilitate engagement of the prong with the threaded bolt and to allow the prong to engage the hexagonal head of a nut or bolt head, the prong is provided with a notch in its free end with the edges of the notch formed at an angle of approximately 120° symmetrically about the longitudinal axis of the yoke whereby the notch may mate with a corner formed by adjacent side surfaces of the nut or bolt head.

Modifications of this basic structure are also described and claimed. One such modification includes an additional set of resilient arms and a second prong are mounted on an end of the yoke opposite the first set of arms. Thus, the clip may be used on a two headed wrench without requiring removal of the clip from the wrench. In another modification, the resilient arms are eliminated and the prong is retained in an engaged position and biased in such position by means of an enlarged shoulder formed on the surface of the prong which shoulder can engage the inner side wall of the working head of the wrench. To provide utilization of the retaining clip on an open end wrench, another form of the invention includes the provision of enlarged nubs at a position adjacent the reverse curved end portions of the arms so that these nubs may spring-fit into the open end of the wrench to abut side surfaces of a nut located in the wrench open end.

These and other objects of the present invention will become more readily apparent when taken together with the following description of the invention in which:

A BRIEF DESCRIPTION OF THE DRAWINGS

FIG. 1 is a perspective view of the wrench retaining clip according to the preferred embodiment of the present invention with such clip being mounted on a wrench in an engaged position on a nut and bolt combination;

FIG. 2 is a top view in perspective of the wrench retaining clip according to the preferred embodiment of the present invention;

FIG. 3 is a perspective view of the wrench retaining clip according to the preferred embodiment of the present invention looking at the underside of such clip;

FIG. 4 is a cross-sectional view taken about lines 4—4 of FIG. 2;

FIG. 5 is a side elevational view in partial cross-section showing the wrench retaining clip in an engaged position with the nut and bolt combination and showing in phantom, the clip in a disengaged position;

FIG. 6 is a perspective view of a first alternate embodiment of the present invention;

FIG. 7 is a top plan view of a second alternate embodiment of the present invention attached to a wrench and nut and bolt combination;

FIG. 8 is a bottom view in perspective of a clip according to a third alternate embodiment of the present invention;

FIG. 9 is a cross-sectional view taken about lines 9—9 of FIG. 8;

And, FIG. 10 is a side elevational view in partial cross-section showing the third alternate embodiment of the present invention attached to a wrench and nut and bolt combination.

DETAILED DESCRIPTION OF THE PREFERRED EMBODIMENT

The present invention is directed to an attachment clip which is adapted to be mounted on wrenches which have a shank and an enlarged working head. The preferred embodiment of the present invention is particularly adapted for use with box end wrenches, but alternate embodiments of the preferred embodiment are suitable for use with open end wrenches or other wrenches which have an elongated shank and a working head. The wrench retaining clip according to the preferred embodiment of the present invention is constructed to be detachable from a wrench so that it may be manufactured and sold as a retrofit item on existing wrenches or as an accessory sold in conjunction with the wrench. The wrench retaining clip is particularly adapted to prevent the working head of a wrench from moving in either longitudinal direction with respect to the threaded bolt, once it has engaged, for example, the nut on a threaded bolt.

As can be seen in FIGS. 1, 2 and 3, a wrench retaining clip 10 according to the preferred embodiment of the present invention is shown mounted on the shank 14 of wrench 12. Wrench 12 has a closed or box end 16 and an open end 18 which are the working heads of wrench 12. Wrench retaining clip 10 includes a yoke 20 which is adapted to extend around shank 14 of wrench 12. Yoke 20 has a top wall 22, a pair of side walls 24 and a bottom wall which is split into opposed, facing wing portions 26 to define a slot 28 between wing portions 26. Thus, yoke 20 defines a generally channel shaped structure which can mateably receive shank 14 for sliding movement in a longitudinal direction therealong.

Clip 10 is provided with releaseable locking means for releaseably retaining yoke 20 in a fixed position with respect to one of the working heads of wrench 12. In the preferred embodiment, this releaseable locking means is defined by a pair of resilient arcuate arms 30 which extend in a common longitudinal direction from yoke 20 to define a semi-circular region 32 surrounded by arms 30. To this end, in the preferred embodiment, arms 30 are formed as continuous extensions of side walls 34 from a common end of yoke 20. Arms 30 extend outwardly from yoke 20 in a generally common plane. Arms 30 diverge from one another to a central portion and then converge to one another to terminate in reverse curved end portions 34 separated by an opening 36. Arms 30 have inner side walls 38, and arms 30 are adapted to engage a working head of wrench 12, such as box end 16 shown in FIG. 1.

In order to retain the working head of wrench 12 in an engaged position with respect to a nut and bolt combination, such as on nut 40 of bolt 42, a prong 44 projects away from yoke 20 in a generally common longitudinal direction with arms 30 but in an offset manner with respect to the plane arms 30. Thus, prong 44 is oriented in a plane that is in generally spaced apart parallel relationship to the plane of arms 30. Prong 44 could be formed in many different shapes and configurations, but, in the preferred embodiment, prong 44 is generally in the form of a flat elongated plate 46 which is secured to top wall 22 of yoke 20 by a connecting wall 48. Wall 48 and plate 46 are preferably formed as continuous extensions of top wall 22, with wall 48 formed at an angle with respect to the plane of top wall 22. Accordingly, wall 48 projects laterally away from top wall 22 to provide the offset for plate 46 of prong 44, as discussed above. Prong 44 terminates in a free end 50 opposite top wall 22, and prong 44 is sized so that free end 50 may engage the threaded shaft 43 of bolt 42 as discussed more fully below. Free end 50 of prong 44 is provided with an angular notch 52 formed by edges 54 and 56 of plate 46. Edges 54 and 56 are formed at an angle with respect to one another and symmetrically about the longitudinal axis of yoke 20 and plate 46 as is shown in FIG. 2. In the preferred embodiment, angle $\alpha$ is selected to be approximately 120° for reasons discussed below.

The operation of wrench retaining clip 10 can now be more fully appreciated by reference to FIGS. 1 and 5. In FIGS. 1 and 5, bolt 42, including bolt head 45 and threaded shaft 43 is shown attached to a flat plate A. Nut 40 is threadably received on threaded shaft 43, and box end 16 is positioned in an engaged or surrounding relationship with respect to nut 40 so that it may mechanically operate nut 40 to either tighten or loosen nut 40 on threaded shaft 43. To this end, box end 16 has an internal side wall 58 which engages the side walls 60 of nut 40 as is standard in the art. Wrench clip 10 is slideable along shank 14 from a disengaged position shown in phantom in FIG. 5 to an engaged position, shown in FIGS. 1 and 5, wherein the free end 50 of prong 44 engages threaded shaft 43 of bolt 42. To this end, it should be appreciated that arcuate arms 30 are sized to embrace the working head of wrench 12, such as box end 16 with prong 44 sized in a longitudinal direction to engage the threads on threaded shaft 43. Free end 50 accordingly terminates at a location generally central of the semi-circle defines by arms 30. Prong 44 has a thickness that allows free end 50 to be inserted between these threads. To this end, arcuate arms 30 are formed of a resilient material so that, as a result of their embracing the working head of wrench 12, on its rounded peripheral surface, arms 30 bias prong 44 into this engaged position. Thus, arms 30 are spring-fit around box end 16 to releaseably retain prong 44 in the engaged position and yoke 20 in an orientation on shank 14 which corresponds to this engaged position.

When it is desired that clip 10 be moved to a disengaged position, yoke 20 is forceably moved along shank 14 in a direction shown in phantom FIG. 5. When this happens, arms 30 expand to release the working head of wrench 12 through opening 36, and prong 44 becomes disengaged with threaded shaft 43. Yoke 20 can then slide along shank 14 with reversed curved end portions 34 sliding along the side edges of shank 14. Reverse curved portions 34 facilitate the movement of clip 10 into the engaged position by guiding arms 30 around the rounded working head of wrench 12.

It should be appreciated that the above described structure enables clip 10 to releaseably lock the working head, such as open end 16, on nut 40 so that box end 16 cannot move in a longitudinal direction with respect to bolt 42. This is caused by the engagement of prong 44 with the threads of the bolt which prevents movement of the wrench head either up or down as shown in FIG. 5. By providing notch 52, a greater area of free end 50 may be inserted between the edges since the angled notch extends around the curved side wall of bolt 42 so that more of prong 44 engages the threads thereon. Preferably, this angle is selected to be approximately 120° since this has proven sufficient to engage these threads. Further, by selecting to be 120°, it is possible to frictionally retain the wrench on bolt head 45 or on nut 40 where there are no threads with which prong 44 may engage. Rather, prong 44 can frictionally abut the adjacent side walls, such as side walls 60 of nut 40 or side walls 62 of bolt head 45 to mate with the corner therebetween. The resiliency of arms 30 tends to bias free end 50 against these side walls with these side walls fitting into notch 52. As is common, a six sided nut or bolt head has adjacent side walls which are angled at 120° to one another.

Since some wrenches are formed with their working heads oriented at an angle with respect to the axis of shank 14, arms 30 may be canted or angled at an angle with respect to the plane of wing portions 26 or top wall 22, as is shown in FIG. 4. It should be appreciated that the plane of walls 22 and wings 26 correspond to the longitudinal axis of shank 14. Preferably, this angle is approximately 5° to 15°, and plate 46 is formed parallel to the plane of arms 30. Thus, plate 46 may also be oriented at an angle of approximately 5° to 15° with respect to the longitudinal axis of shank 14.

Also, to allow wrench retaining clip 10 to be mounted on an existing wrench, slot 28 is provided so that a narrow edge of shank 14 may be inserted through slot 28 and then clip 10 twisted around shank 14 to the position shown in FIG. 1. To this end, clip 10 is preferably stamped or formed out of any convenient resilient material, such as plastic or metal. For example, clip 10 may be formed out of many of the 300 and 400 series steels or out of barilium copper through a single stamping or set of progressive metal working dyes. Similarly, the clip could be formed by injection molding and constructed out of high density polypropylene or polyethylene or could be formed from ABS plastic.

A first alternate embodiment of the present invention is shown in FIG. 6 and basically comprises a wrench retaining clip similar to that described with respect to FIGS. 1–5, but which is directed to interacting with each working head of the wrench without the necessity for removing the clip from the wrench shank. Specifically, as is shown in FIG. 6, wrench retaining clip 70 is formed of a main yoke 72 which is constructed similarly to that described with respect to yoke 20. Yoke 72 has a top wall 74 and a pair of side walls such as side wall 76, and a pair of opposed facing wings, such as wing 78 which define a slot 80 there between. A first pair of arcuate arms 82 extend in a common direction outwardly from side walls 76 of yoke 72 to define a semi-circular region 84 adapted to releaseably embrace a working head of a wrench. Arms 82 terminate in reverse curved end portions 86 which are in opposed facing relationship to one another about an opening 88. A prong 90, configured the same as prong 44, extends from top wall 74 of yoke 72 to lie in spaced-apart relation to the plane of arms 82 over semi-circular region 84. A second pair of arcuate arms 92 extend from side wall 76 of yoke 72 opposite arms 82. Arms 92 define a semi-circular region 94 therebetween. Each arm 92 terminates in a reversed curved end 96 with ends 96 being in spaced-apart opposed relation to one another about an opening 98. A prong 100 extends in a common direction with arms 92 from top wall 74 of yoke 72 and is configured similarly to prong 90 and prong 44, described above.

Wrench retaining clip 70, is thus configured to be positioned about the shank of the wrench, such as wrench 12, by inserting the shank of the wrench through slot 80 and snap-fitting yoke 72 around the shank of the wrench. Clip 70 may be slid in opposite directions along the wrench shank between a totally disengaged position at a midpoint of the shank to a first engaged position wherein arms 82 embrace one working head of the wrench or to a second engaged position wherein arms 92 embrace the opposite working head of the wrench. In this manner, then, retaining clip 70 does not have to be removed to be used on each working head of a dual headed wrench.

A second alternate embodiment of the present invention is shown in FIG. 7. In this embodiment, wrench retaining clip 110 is configured to be employed with an open end working head of wrench 112. Wrench 112 has a shank 114 and a working head, such as open end 118. Clip 110 includes a main body or yoke 120 adapted to extend around shank 114 in the manner of that described with respect to the preferred embodiment of the present invention. Arcuate arms 128 and 130 extend in a common direction from yoke 120 and define a semi-circular region therebetween. Each of arms 128, 130 terminate in a reversed curved portion 132, 134, respectively, and portions 132, 134 are in opposed relation to one another to define an opening 136 there between. The reverse curved ends 132 and 134, in this embodiment, however, are enlarged to define nubs 138 and 140, respectively, which are positioned to project generally into the open region 122 between jaws 124 and 126 of open end working head 118. Thus, when the working head 118 is mounted on nut 40, nubs 138 and 140 will abut adjacent side walls 60 of nut 40. In this manner, wrench 112 is prevented from being removed from nut 20. Elongated prong 142 extends from yoke 120 in a common direction as arms 128 and 130. Prong 142 is sized to engage threads on threaded shaft 43 and includes a notch 144 on its free end. Notch 144 is formed substantially the same as notch 52, but it should be appreciated that prong 142 is typically dimensioned longer in a longitudinal direction so that it can engage the threads on shaft 43. Other than this increase in dimension, though, prong 142 is substantially the same as prong 44.

A third embodiment of the present invention is shown in FIGS. 8, 9 and 10 and comprises a wrench retaining clip that eliminates the requirement for the arcuate arms such as arms 30 of the preferred embodiment. As is seen in these figures, retaining clip 150 includes a channel-shaped yoke 152 having a top wall 154, a pair of side walls 156 and a pair of inwardly projecting wings 158 in opposed facing relation to one another and separated by a slot 160. A resilient prong 162 extends outwardly from yoke 152 as an extension of top wall 154. Prong 162 includes a main portion or flat plate 164 which is connected to top wall 154 by an angled connecting wall 166. Prong 164 has a free end 168 into which notch 170 is formed, with notch 170 being substantially the same as notch 52 in the preferred embodiment of the present invention. A shoulder 172 is formed on a mid portion of plate 164 and operates as the releaseable locking means to hold free end 168 in engagement with the threads on a bolt shaft. As is seen in FIG. 9, shoulder 172 has an inclined wall 174 at a leading end thereof adjacent free end 168 and an angled wall 176 interconnecting the trailing edge of wall 174 and plate 164. Wall 176 is formed generally perpendicularly to wall 174 and is operative to retain prong 162 in an engaged position as discussed below.

With reference to FIG. 10, the operation of clip 115 may now be more readily understood. As is shown in FIG. 10, bolt 42 includes a threaded shaft 43 and a bolt head 45. Bolt 42 extends through a plate A and is connected thereto by means of nut 40. A working head or box end 180 of wrench 182 is mounted on nut 40, and box end 180 includes an internal side wall 184 which abuts the side walls of nut 40. Yoke 152 is secured on shaft 186 of wrench 182 in that manner described with respect to the other embodiments of this invention. Yoke 152 is slideable along shank 186 but is retained in the position shown in FIG. 10 wherein prong 162 engages threaded shaft 43 at free end 168. As can be seen, shoulder 172 releaseably locks prong 162 in this engaged position by snap-fitting into the open area between threaded shaft 43 and side wall 184 of box end 180. In this position, angled wall 176 abuts side wall 184 so that prong 162 is maintained in the engaged position.

It should be appreciated, then, that prong 162 is preferably formed of a resilient material that has spring-like capabilities so that it will snap-fit or snap-lock onto the working head of wrench 182. As clip 150 is advanced from a disengaged position (not shown) inclined wall 174 will abut the edge of box end 180 to bend prong 162 away from its normal position so that it may then snap into place between threaded shaft 43 and side wall 184. When it is desired to remove wrench 182 from its engaged relationship with nut 40, yoke 152 is moved to the right, in FIG. 10, and angled wall 176 causes prong 162 to bend outwardly away from box end 180 so that prong 162 is released from threaded shaft 43.

While the foregoing invention has been described with respect to the preferred embodiments of the present invention, it is to be understood that the scope of this invention is defined by the following claims limited only by the prior art. Accordingly, various changes and modifications of this invention are included within the scope of these claims and may be made without departing from the scope of the invention described herein.

I claim:

1. An attachment clip adapted to mount on wrenches having a shank and a working head and operative to retain the working head on a nut and threaded bolt, the clip comprising:

a yoke extending at least partially around said shank and slideable therealong;

a first prong member connected to said yoke and having a free end adapted to engage the threads of said bolt when said free end is placed in abutting relation to said bolt, said free end moveable between an engaged position and a disengaged position as said yoke is slid in opposite directions on said shank; and releasable retaining means associated with said first prong for releasably and resiliently retaining said first prong member in said engaged position whereby said free end engages said threads, said releasable retaining means including a pair of resilient arms extending outwardly from said yoke and adapted to embrace said working head when said free end is in said engaged position and to bias said free end into said engaged position.

2. Apparatus according to claim 1 wherein said arms are oriented in a common plane, said plane being oriented at an acute angle with respect to the longitudinal axis of said shank when said yoke is positioned thereon.

3. Apparatus according to claim 2 wherein said angle is between 5° and 15°, inclusively.

4. Apparatus according to claim 1 wherein said arms are arcuate in shape to define a circular region configured to receive said working head, said arms each terminating in a reverse curved end portion in opposed relation to one another to define an opening therebetween, said free end positioned adjacent a central portion of said circular region.

5. Apparatus according to claim 4 wherein each end portion includes an enlarged nub projecting laterally of its respective arm in a direction opposite its associated reverse curve.

6. Apparatus according to claim 1 wherein said free end has a notch formed therein, the edges of said notch defining an angle of approximately 120° with each other, said notch positioned symmetrically about the longitudinal axis of said prong member.

7. Apparatus according to claim 1 wherein said first prong member is laterally offset from said yoke and extends in a plane spaced apart from and generally parallel to the longitudinal axis of said shank when said yoke is mounted thereon.

8. Apparatus according to claim 1 wherein said wrench has a pair of working heads on opposite ends of said shank, said clip further including a second prong member on an opposite end of said yoke from said first prong member, said second prong member having a second free end adapted to engage the threads of the bolt; and a second pair of resilient arms extending from said opposite end and operative to embrace an associated working head when said second prong member engages said threads and to bias said second prong member into an engaged position with said threads when its associated working head engages one of said nut and bolt.

9. A clip device adapted to mount on a shank of a wrench having a working head configured to engage a nut or bolt head in a threaded nut and threaded bolt combination, the clip device comprising:

an elongated channel-shaped yoke having a top wall, a pair of side walls, a pair of bottom walls extending toward one another in an opposed relation from respective ones of said side walls to define a slot therebetween, said yoke being generally open at a first and a second end and adapted to releasably and slideably mount on said shank:

a first prong member extending from said top wall at said first end of said yoke and having a free end adapted to engage the threads of said bolt when said free end is placed in abutting relation to said bolt; and a first pair of arcuate arms each extending in a generally longitudinal direction from a respective one of said side walls at the first end of said yoke, said arms formed of a resilient material and configured in a semicircle and adapted to releasably bias said first prong into an engaged position.

10. Apparatus according to claim 9 wherein said first prong member is formed as a strip having an elongated main body portion defined by a flat plate and a connecting wall interconnecting said main body portion and said top wall, said connecting wall oriented at an angle with said top wall and projecting away from said yoke, said main body portion oriented in a spaced-apart, substantially parallel plane with respect to the plane of said top wall.

11. Apparatus according to claim 10 wherein said main body portion has a notch formed in its free end to define a pair of angular points symmetric about the longitudinal axis of said main body portion, the edges of said notch formed at an angle of approximately 120° with respect to each other.

12. Apparatus according to claim 9 including a second prong member extending from said top wall in a direction opposite the first prong and having a second free end adapted to engage the threads of said bolt when said second free end is placed in abutting relation thereto, and a second pair of arcuate arms each extending from a respective one of said side walls opposite said first pair of arcuate arms, said second pair of arcuate arms formed of a resilient material and configured in a semicircle with said second pair of arms adapted to releaseably bias said second prong into an engaged position.

13. Apparatus according to claim 2 or 12 wherein said arms are formed as extensions of said side walls and are oriented at an acute angle of between 5° and 15° with respect to the plane of said top wall.

14. Apparatus according to claim 9 or 12 wherein said arms terminate in reverse curved free ends.

15. In combination with a wrench having a shank and at least one working head configured with an outer peripheral surface and an inner surface for receiving a selected one of a nut and a head of a threaded bolt in a threaded nut and threaded bolt combination for forcibly rotating said nut and bolt in opposite angular directions with respect to one another, the improvement comprising a retaining clip including a body member slideably mounted on said shank, a prong extending from said body member and terminating at a free end adapted to engage the threads of said bolt, a pair of resilient arcuate arms extending from said body member and configured in a semicircle, said arms adapted to releasably bias said prong into an engaged position with said threads by acting against the outer peripheral surface of said working head when it is placed on the selected one of said nut and bolt in order to prevent the movement of said working head longitudinally with respect to said bolt.

16. Apparatus according to claim 15 wherein said main body is a hollow sleeve having a longitudinal slot extending entirely through a side wall of said sleeve along the length thereof.

17. An attachment clip adapted to mount on wrenches having a shank and a working head and operative to retain the working head on a nut and threaded bolt, the clip comprising:

a yoke extending at least partially around said shank and slideably therealong;

a first prong member connected to said yoke and having a free end adapted to engage the threads of said bolt when said free end is placed in abutting relation to said bolt, said free end moveable between an engaged position and a disengaged position as said yoke is slid in opposite directions on said shank; and releaseable retaining means associated with said first prong for releasably and resiliently retaining said first prong member in said engaged position whereby said free end engages said threads, said releasable retaining means including a shoulder on said first prong member, said shoulder positioned to engage said working head when said free end engages said threads.

* * * * *